US008741163B2

(12) United States Patent
Suedes

(10) Patent No.: US 8,741,163 B2
(45) Date of Patent: Jun. 3, 2014

(54) METHOD FOR PRODUCING A COMPOSITE BODY HAVING A SELF-SUPPORTING SURFACE

(76) Inventor: Werner Suedes, Pforzheim (DE)

( * ) Notice: Subject to any disclaimer, the term of this patent is extended or adjusted under 35 U.S.C. 154(b) by 113 days.

(21) Appl. No.: 13/517,930

(22) PCT Filed: Dec. 29, 2009

(86) PCT No.: PCT/EP2009/009301
§ 371 (c)(1),
(2), (4) Date: Jun. 20, 2012

(87) PCT Pub. No.: WO2011/079850
PCT Pub. Date: Jul. 7, 2011

(65) Prior Publication Data
US 2012/0255931 A1 Oct. 11, 2012

(51) Int. Cl.
*C25D 1/10* (2006.01)
*C25D 1/04* (2006.01)
*C25D 1/02* (2006.01)
*C25D 5/10* (2006.01)
*C25D 5/48* (2006.01)

(52) U.S. Cl.
CPC .. *C25D 1/04* (2013.01); *C25D 1/02* (2013.01); *C25D 5/10* (2013.01); *C25D 1/10* (2013.01); *C25D 5/48* (2013.01)
USPC ..... 216/52

(58) Field of Classification Search
None
See application file for complete search history.

(56) References Cited

U.S. PATENT DOCUMENTS

| | | | | |
|---|---|---|---|---|
| 2,001,998 | A | 5/1935 | Bart | |
| 2,761,828 | A | 9/1956 | Eldredge et al. | |
| 3,364,548 | A | 1/1968 | Marco | |
| 4,492,020 | A | 1/1985 | Cobb | |
| 4,530,740 | A | 7/1985 | Wolf et al. | |
| 6,027,630 | A * | 2/2000 | Cohen | 205/135 |
| 2002/0187648 | A1 * | 12/2002 | Wu et al. | 438/745 |
| 2004/0146611 | A1 * | 7/2004 | Arias et al. | 426/106 |
| 2013/0019918 | A1 * | 1/2013 | Boukai et al. | 136/238 |
| 2013/0193065 | A1 * | 8/2013 | Brueck et al. | 210/500.23 |

OTHER PUBLICATIONS

International Preliminary Report on Patentability (Aug. 9, 2012), for corresponding International Application PCT/EP2009/009301.

* cited by examiner

*Primary Examiner* — Allan Olsen
(74) *Attorney, Agent, or Firm* — WRB-IP LLP

(57) ABSTRACT

A method is provided for producing a composite body made of at least one self-supporting surface and at least one element connected to the surface in a coating process. The method includes providing a negative mold including the at least one element of the composite body, selectively ablating a surface of the negative mold to be coated with the at least one self-supporting surface by a defined first thickness so that the at least one element stands out from the surface as a projection at least in areas, depositing one or more layers for forming the at least one self-supporting surface having a defined second thickness, wherein an elevation forms in the area of the projection of the at least one element, leveling the coated surface, wherein the elevation is removed, and selectively removing at least parts of the negative mold.

15 Claims, 4 Drawing Sheets

METHOD FOR PRODUCING A COMPOSITE BODY HAVING A SELF-SUPPORTING SURFACE

BACKGROUND AND SUMMARY

The invention relates to a method for producing a composite body having a self-supporting surface.

It is known how to produce self-supporting surfaces by means of coating methods. For example, a method is known from DE 33 15 407 A1 where for heat exchangers for example, cavities or closed ducts are sealed from the outside using cover layers produced by electroplating. Elongated fillers are inserted into the cavities or ducts to be coated and are later removed, and at one end project from the cavity or the duct, wherein the remaining space inside the cavity or duct around each filler is filled with wax. After removal of the filler, the opening in the wax resulting from its removal is sealed with a wax plug and the covering layer is applied by galvanization.

U.S. Pat. No. 3,364,548 discloses a method for producing a heat exchanger by electroforming. A negative mold is provided by stacking thin copper sheets and thick aluminum sheets one on top of the other. The stack has a rectangular cross-section. The top and the bottom of the stack are of copper sheet. The copper sheets project beyond the aluminum sheets, wherein the thickness of the aluminum sheets corresponds to the later required duct cross-sections. The unevennesses of the side walls of the stack are removed by spraying a thick layer of a soft aluminum alloy onto the side walls of the stack. The sprayed-on aluminum layer not only fills in the unevennesses on the side walls, but holds the stack together axially.

The coated side walls are smoothed such that the edges of the copper sheets become visible on the surface of the side walls. This is then followed by selective pickling of the sprayed-on aluminum layer by about 250 μm to about 750 μm. A copper layer of about 750 μm to 1000 μm thickness is then applied to the side walls, wherein the previously exposed edges of the copper sheet are buried in the copper layer. The thickness of the copper layer is selected to match the required robustness and compressive strength of the heat exchanger.

The stack is beveled at its narrow sides such that the aluminum sheets in the interior of the stack are likewise beveled and their beveled edges are exposed, wherein a copper web remains in the center of the narrow side. The beveled surfaces are masked such that masked surfaces and exposed aluminum surfaces are obtained. The adjacently positioned beveled narrow sides are masked in a height-offset manner, such that the exposed edges of the aluminum sheets predetermine height-offset ducts of the heat exchanger. The stack is in turn coated with copper and the exposed aluminum sheets are dissolved out, such that a copper framework inside a copper envelope remains to form the heat exchanger.

It is desirable to provide a method for producing a composite body made of at least one self-supporting surface and at least one element connected to the surface in a coating process, wherein a stable connection can be created between the self-supporting surface and the element.

A method is proposed for producing a composite body comprising at least one self-supporting surface and at least one element connected to the surface in a coating process, wherein a negative mold is provided which has the at least one element of the composite body and wherein the following steps are performed:

(a) smoothing the negative mold (10) on a surface (18) to be coated as a whole prior to a selective ablation in order to set the at least one element in the negative mold (10) to a required dimension;

(b) selectively ablating the surface of the negative mold to be coated with the at least one self-supporting surface by a defined first thickness such that the at least one element stands out from the surface as a projection at least in some areas, wherein the first thickness (d14) is between 5 μm and 25 μm;

(c) depositing one or more layers for forming the at least one self-supporting surface having a defined second thickness, wherein an elevation forms in the area of the projection of the at least one element and the projection (22) of the at least one element (20, 20*a*, 20*b*, 20*c*) is embedded in the surface (30), wherein the surface (30) has a thickness of a few tens of μm;

(d) leveling the coated surface, wherein the elevation is removed and a surface (40) of homogeneous appearance is formed; and (e) selectively removing at least parts of the negative mold.

Advantageously, a firm connection of the at least one element to the surface can be produced. The surface can have a thickness of only a few tens of micrometers. By specifying an appropriate oversize, a high dimensional accuracy of the negative mold and the surface can be achieved. The top of the surface can be treated without influencing the adhesion between the at least one element and the surface. In particular, finish-turning of the negative mold as a whole is possible, such that the at least one element in the negative mold can be brought to a required dimension. The method in accordance with the invention is particularly suitable for connecting one or more thin-walled elements to a foil of comparable wall thickness, e.g. for connection of one or more elements each having a thickness of a few 10 μm to a foil of comparable thickness.

A selective ablation prior to coating can be advantageously performed using wet chemicals, for example by chemical pickling, by electrolytic pickling, by an electrolytic polishing bath and the like, however other methods are also conceivable, for example with vacuum methods, in particular when only low thicknesses have to be ablated, for example by means of cathode sputtering or plasma-assisted etching, or for greater thicknesses for example by sandblasting, glass blasting and the like. An ablation of 5-25 μm, preferably between about 10 and 20 μm is favorable.

The deposition of the at least one layer can be performed with various methods. For example the coating can be performed using PVD methods such as cathode sputtering, vapor deposition and/or CVD methods such as reactive plasma-assisted vacuum coating methods, or also with current-free or electrochemical galvanic processes. One or more layers embed the at least one element inside the deposited layers at its projecting end. A stable connection is produced between the at least one element and the surface. The one or more layers can be insulating, semi-conducting and/or metallic. The person skilled in the art will select a suitable method or a suitable combination of various methods for the respectively required embodiment of the composite body as regards layer thickness and material.

In accordance with an advantageous method step, the deposition of the one or more layers onto the negative mold can be achieved by electroforming. Electroforming permits a readily controllable and reproducible deposition of layers having thicknesses in the range of several tells of micrometers.

In accordance with an advantageous method step, the negative mold can be smoothed before the selective ablation on the surface to be coated as a whole, e.g. finish-turned and/or ground. A simple handling of the negative mold composed of several parts is enabled. In particular, the elements can, during assembly with the parts of the negative mold, have a greater diameter and do not need to be adapted right from the start to the dimension of the negative mold. The parts can be considerably thicker than the element(s) and thus ensure stability of the negative mold, which therefore can also be readily machined. The adaptation to a common dimension of element(s) and parts is achieved by smoothing of the surface, wherein protruding areas are ablated. This permits a high dimensional accuracy of the negative mold. It is however also conceivable, alternatively or additionally, to roughen the surface after finish-turning of the negative mold, depending on the required inner surface of the subsequently self-supporting surface.

In accordance with an advantageous method step, the selective ablation of the negative mold can be performed by a wet-chemical treatment, for example with an alkaline pickle. A defined chemical ablation of the ablatable areas of the negative mold can thus be performed under defined conditions, wherein the at least one element remains unaffected or at least has only a considerably lower etching rate than the ablatable areas of the negative mold.

In accordance with an advantageous method step, the negative mold can be produced with an oversize relative to a final dimension of the negative mold. This allows the surface to be ablated by selective ablation to the required final dimension of the negative mold. The oversize can be adjusted to match an ablation rate during the selective ablation, such that the method can be adapted to different materials and pickles in a simple manner.

In accordance with an advantageous method step, the surface can have a greater thickness than the projection of the at least one element. In this case, the projection of the at least one element can be eliminated.

In accordance with an advantageous method step, the surface can have a thickness greater by a factor of 5 than the projection of the at least one element. It is clear that the projection is already less pronounced due to the high layer thickness and somewhat leveled.

In accordance with an advantageous method step, the surface can be formed from a first and a second layer, wherein the first layer has a lower thickness than the second. The first layer can be advantageously at most half as thick as the second one. The first layer can produce an advantageous adhesion to the at least one element. The first layer can therefore be formed from the same material as the at least one element. The second layer can then be selected to have particularly favorable properties for the surface treatment of the later self-supporting surface, for example to act as a functional layer or the like.

In accordance with an advantageous method step, the elevation can be ablated in that the coated negative mold is overall finish-turned and/or ground. Thanks to the fact that the layer sequence deposited on the negative mold is thicker than the projection, the elevation can be removed without impairing the embedding of the at least one element into the coating. It is even possible to achieve a reflecting surface. Machining of the surface is advantageously made easier, since the coating is permanently connected by the element embedded in some areas with the negative mold.

In accordance with an advantageous method step, a surface treatment can precede the galvanic deposition to increase the adhesive strength between the at least one element and the surface. For example, the surface can be roughened or an adhesion promoting layer applied to it.

In accordance with an advantageous method step, the surface can be polished before removal of the negative mold. The surface is stabilized by the negative mold as it is permanently connected to the negative mold.

In accordance with an advantageous method step, the negative mold can be removed by selective chemical etching. The negative mold can therefore also be removed through complex structures of the at least one element that are not accessible to machining. The negative mold can be removed without the at least one element being removed. Optionally, a coloring step can follow in which the at least one element is colored, for example to obtain an increased absorption or achieve a required color impression.

In accordance with an advantageous method step, the surface can be produced from a layer of copper or a copper-containing component and from a layer of nickel or a nickel-containing component deposited thereon. Nickel has the advantageous property of leveling uneven areas with a high layer thickness and of forming a glossy surface.

In a favorable case, the at least one element can be produced from copper or a copper-containing component. Copper is for example relatively inexpensive, has a high thermal conductivity and can be easily treated, e.g. colored, to create optical effects, such as increased absorption, a color impression and the like.

In a favorable case, the negative mold can be produced at least in some areas from aluminum. For example, the negative mold can be produced in that an aluminum part and an element to be connected to the self-supporting surface are joined together alternatingly in a stacking direction to form a stack and that the stack is subjected to a compressive stress in the stacking direction. The stack forms a stable and easy to handle multi-part negative mold that can be excellently machined.

It is particularly advantageous that the invention can be used for producing a composite body from at least one self-supporting surface and at least one element connected to the surface in a coating process, the body being produced by the following steps:

(a) providing a negative mold comprising the at least one element of the composite body, (b) selectively ablating a surface of the negative mold to be coated with the at least one self-supporting surface by a defined first thickness such that the at least one element stands out from the surface as a projection at least in some areas, (c) depositing one or more layers for forming the at least one self-supporting surface having a defined second thickness, wherein an elevation forms in the area of the projection of the at least one element, (d) leveling the coated surface, wherein the elevation is removed, selectively removing at least parts of the negative mold.

Advantageously, composite bodies for a wide range of applications can be provided, for example for optical components, for decorative applications and the like.

BRIEF DESCRIPTION OF THE DRAWINGS

The invention is described in more detail in the following on the basis of an embodiment illustrated in the drawing. The schematic representation shows in.

Elements which are identical or have identical effects are provided in the drawings with the same reference numbers.

DETAILED DESCRIPTION

The invention relates to a method for producing a composite body comprising at least one self-supporting surface and at least one element connected to the surface in a coating process, wherein various steps are performed consecutively. First a negative mold comprising the at least one element of the composite body is provided. Selective ablation is performed of a surface of the negative mold to be coated with the at least one self-supporting surface by a defined first thickness, such that the at least one element stands out from the surface as a projection at least in some areas. This is followed by depositing one or more metallic layers for forming the at least one self-supporting surface with a defined second thickness, wherein an elevation forms in the area of the projection of the at least one element. Then the coated surface is leveled, wherein the elevation is removed. Finally, selective removal of the negative mold is performed.

Figure 1:
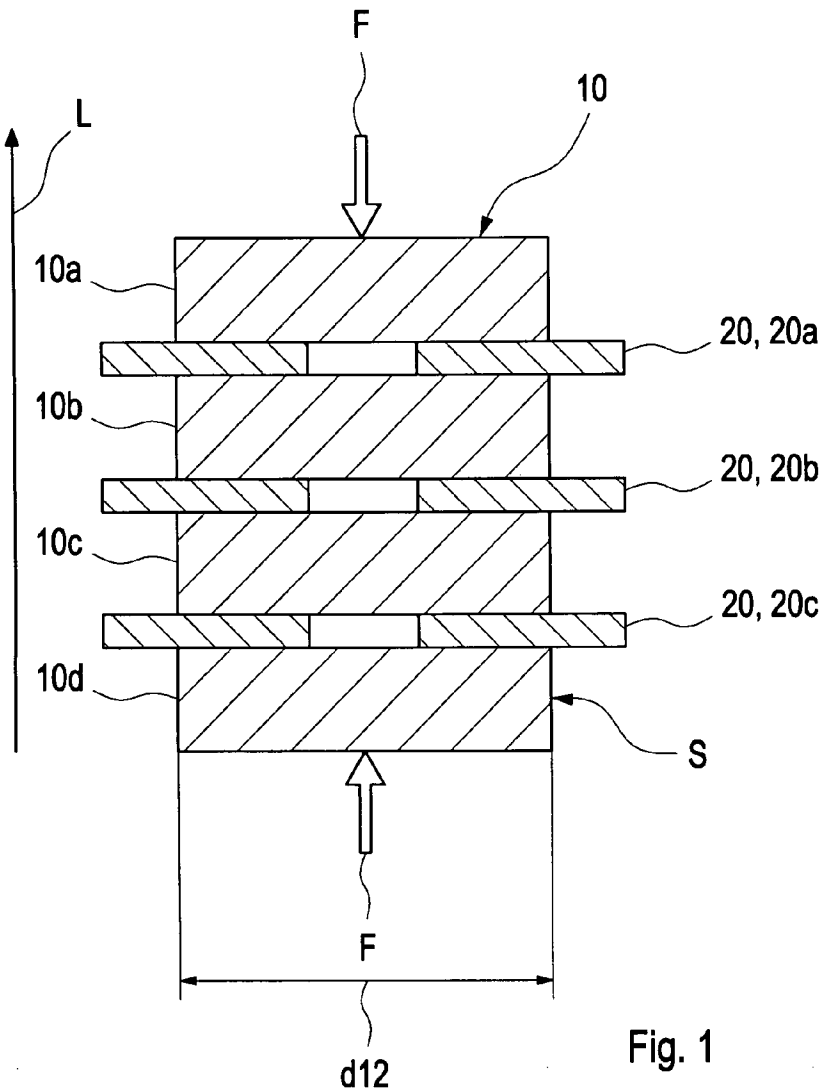
FIG. 1 an embodiment by way of an example of a blank mold of a negative mold having projecting elements that are to be connected to a self-supporting surface.

FIG. 1 shows an exemplary embodiment of a blank mold of a negative mold 10 having several elements 20*a*, 20*b*, 20*c* arranged in the negative mold 10 and identified overall with 20. The negative mold 10 is shown in the following as a cylinder. The negative mold 10 can however also be designed as, for example, a cone or as a hemisphere or as a sphere.

The elements 20 are, by way of example, designed as rings arranged between parts 10*a*, 10*b*, 10*c*, 10*d* of the for example cylindrically designed negative mold 10 and aligned in their outer circumference with the outer circumference of the negative mold 10. The elements 20 can of course also be of different design depending on the application, for example as a network or just as individual sections instead of as closed rings. The rings have for example a thickness between 20 and 90 μm, in particular between around 40 to 80 μm, for example about 50 μm.

The parts 10*a*, 10*b*, 10*c*, 10*d* of the negative mold 10 can be produced as rings or disks of aluminum, between which the elements 20*a*, 20*b*, 20*c* are alternatingly inserted in order to form a stack S in a stacking direction L. The parts 10*a*, 10*b*, 10*c*, 10*d* can be considerably thicker than the elements 20*a*, 20*b*, 20*c*, 20*d*, about ten times thicker, e.g. be several millimeters thick. The parts 10*a*, 10*b*, 10*c*, 10*d* have for example a diameter d12.

The elements 20*a*, 20*b*, 20*c* can comprise a different material than that of parts 10*a*, 10*b*, 10*c*, 10*d*, for example copper. By subjecting the stack S to compressive stress in the stacking direction L, e.g. using screws, a compact negative mold 10 is obtained that can be readily machined. The elements 20*a*, 20*b*, 20*c* can in the installed state project in diameter beyond the parts 10*a*, 10*b*, 10*c*, 10*d* and are not finish-turned together with the latter to a required common diameter d10, as can be seen in FIG. 2, until the next step.

Finally, a surface 30 (FIG. 4-FIG. 7) is deposited onto the negative mold 10, said surface being connected by the coating process to the elements 20*a*, 20*b*, 20*c* and self-supporting after removal of the parts 10*a*, 10*b*, 10*c*, 10*d* of the negative mold 10. In this embodiment, the self-supporting surface 30 forms for example a closed sleeve.

Figure 2:
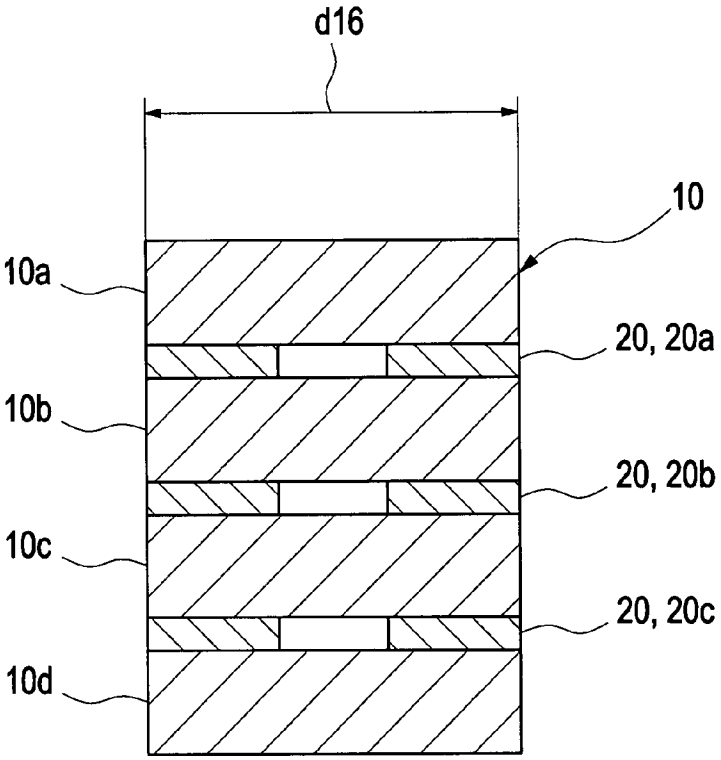
FIG. 2 the negative mold from FIG. 1 with indicated oversize and final dimension.

Starting from the negative mold 10 in FIG. 1, in a first method step according to FIG. 2 for dimensionally accurate producing of the self-supporting surface 30 (FIG. 4-FIG. 7) the negative mold 10 is finish-turned and/or ground as a whole to a diameter d16. Since the negative mold 10 is pressed together by compressive stress, the surface machining over the entire shaped body of the negative mold 10 is performed with the usual low production tolerances, although the negative mold 10 is composed of various individual parts, parts 10*a*, 10*b*, 10*c*, 10*d* and elements 20*a*, 20*b*, 20*c*. The individual parts (parts 10*a*, 10*b*, 10*c*, 10*d* and elements 20*a*, 20*b*, 20*c*) can as a result all be machined to the same dimension simultaneously. Although the elements 20*a*, 20*b*, 20*c* are very much thinner than the parts 10*a*, 10*b*, 10*c*, 10*d*, they can be machined without any problem. The diameter d16 has an oversize relative to the diameter d10 that is generated in the next method step in FIG. 3.

Figure 3:
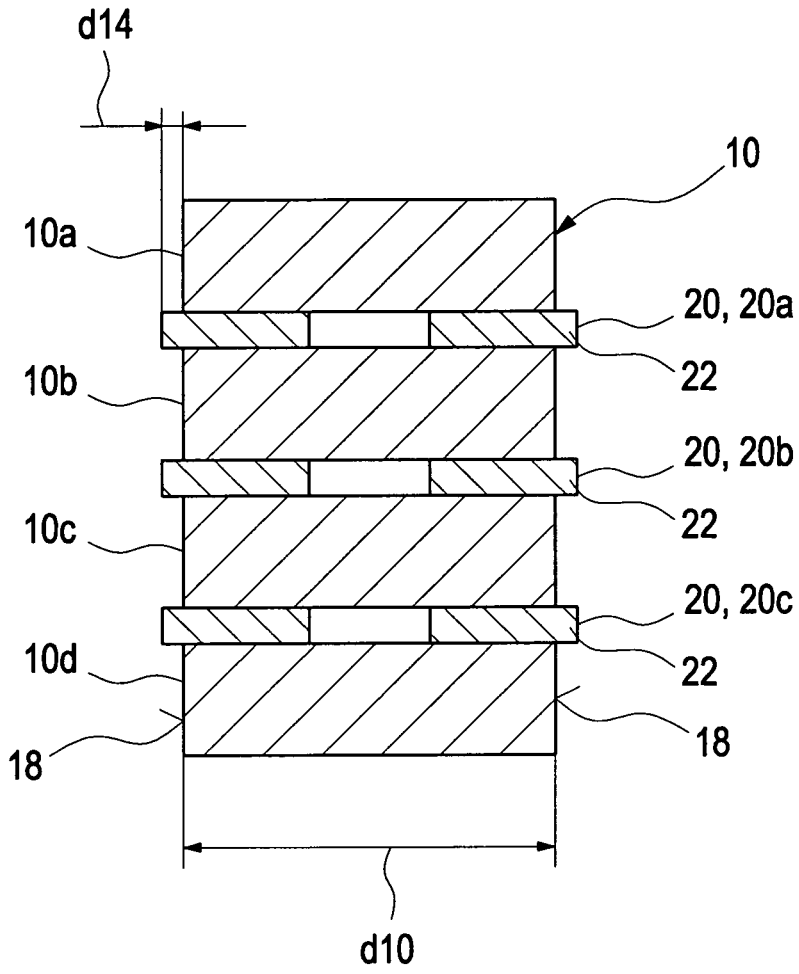
FIG. 3 the negative mold from FIG. 2 with ablated surface before coating.

FIG. 3 shows the result of the further method step, in which a surface 18 to be coated is selectively ablated by a thickness d14. The negative mold 10 from FIG. 2 is shown with ablated surface 18 before coating and now has the diameter d10. The diameter d10 of the negative mold 10 corresponds to the internal diameter of the self-supporting surface 30 (FIGS. 4-7).

The surface layer of thickness d14 of the surface 18 of the negative mold 10 to be coated with the subsequently self-supporting surface 30 can be selectively ablated, for example by a pickle. The individual parts 10*a*, 10*b*, 10*c*, 10*d* of the negative mold are here selectively ablated at their outer circumference, while the elements 20*a*, 20*b*, 20*c* designed for example as rings are not ablated and protrude with a projection 22 from the surface 18. In the case of aluminum parts 10*a*, 10*b*, 10*c*, 10*d*, the selective ablation can be performed with caustic soda.

The thickness d14 of the ablation of the surface 18 can for example be in the range of 10-20 μm. The thickness d14 can for example advantaeously be adapted to a diameter of the individual elements 20*a*, 20*b*, 20*c*.

After ablation of the thickness d14, the negative mold 10 has in the area of the parts 10*a*, 10*b*, 10*c* and 10*d* the required external diameter d10, which in the end determines the internal diameter of the surface 30 (FIG. 4-FIG. 7), while the elements 20*a*, 20*b*, 20*c* protrude with a defined projection 22. The diameter of the elements 20*a*, 20*b*, 20*c* was defined by the surface treatment, e.g. finish-turning, of the negative mold 10 in the preceding method step. The projection 22 is intended to be embedded in the surface 30 yet to be formed (FIG. 4-FIG. 7) and to anchor the elements 20*a*, 20*b*, 20*c* inside it in stable manner.

Figure 4:
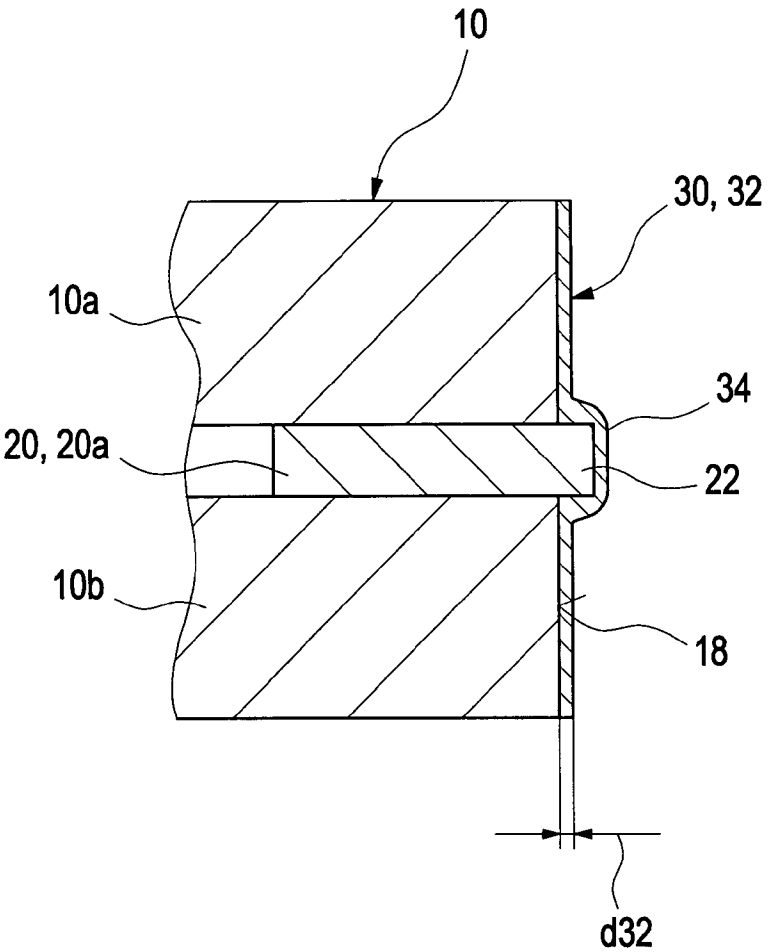
FIG. 4 the negative mold from FIG. 3 coated with a first layer.

FIG. 4 shows a first coating step as a detail of the negative mold 10, wherein the negative mold 10 from FIG. 1 is coated with a first layer 32 of thickness d32. The first layer 32 can for example be of copper, which can be connected particularly well to elements 20 (illustrated by element 20*a* in the section shown) of copper. During deposition onto the surface 18 to be coated, the layer 32 is also laid over the projection 22 and forms an elevation 34. Optionally, a thin, e.g. 2-3 μm thick adhesion promoting layer, e.g. zinc from a zincate pickle, can be applied before the layer 32.

The deposition of the layer 32 onto the surface 18 to be coated can be performed advantageously by means of galvanic deposition. The uncoated negative mold 10 is here immersed into an electrolyte and used as a cathode. An electric potential is applied between the cathode and an anode, e.g. made of copper. After optional application of an adhesion promoting agent, for example a part of the layer 32 is deposited with a high current density and the rest of the layer with a lower current density. The electrolyte can change here. In the case of copper as the layer 32, it has proved advantageous to deposit ⅓ of the copper layer from a cyanide electrolyte at for example around 1 A/dm$^2$ and 1-3 V. The remaining ⅔ of the copper layer can be deposited, on account of the better spread, from an acid electrolyte at 0.5 A/dm$^2$ at about 1 V. Electrolyte copper is used as the counter-electrode. The negative mold 10 can be advantageously contacted via a thread.

Figure 5:
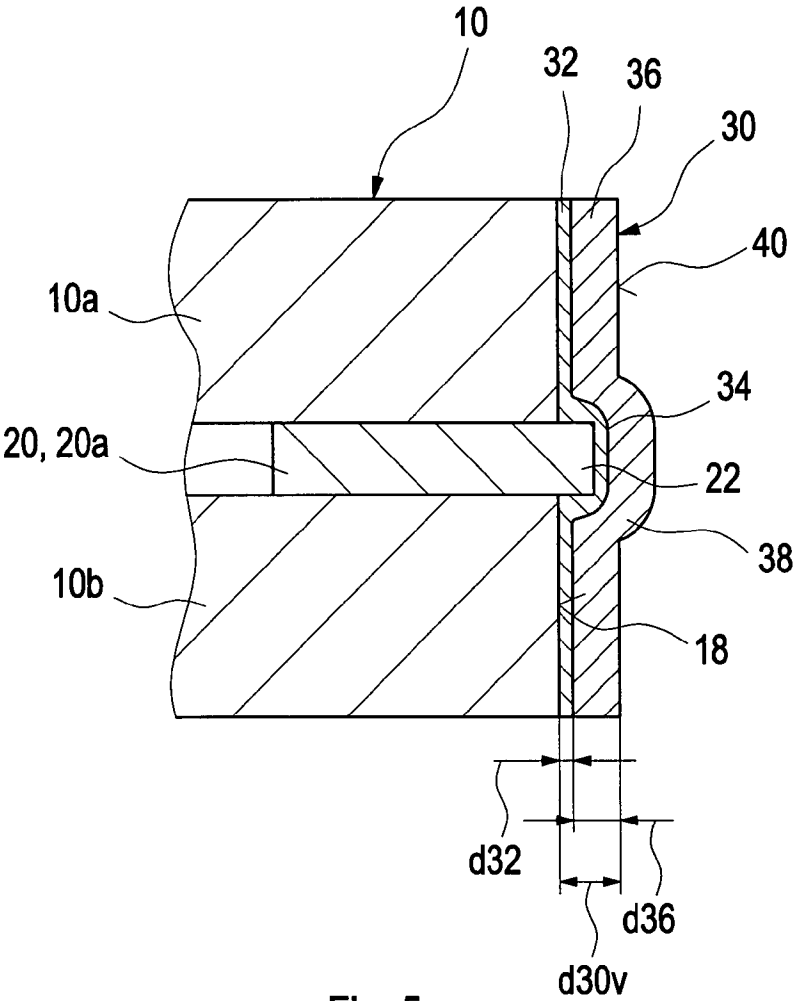
FIG. 5 the negative mold from FIG. 4 coated with a second layer.

As shown in FIG. 5, in a second coating step a second layer 36 with a thickness d36 is deposited on the first layer 32.

The deposition of the galvanic layer 36 onto the surface 18 to be coated can also be advantageously performed by means of galvanic deposition. The negative mold 10 coated with the first layer 32 is immersed in an electrolyte and used as a cathode. An electric potential is applied between the cathode and an anode, e.g. made of nickel. A sulfamate-nickel bath can be used as the electrolyte, for example with 0.5 A/dm$^2$ at about 1 V voltage with slightly increased temperature, e.g. around 50° C. Sulfur-depolarized nickel has proved favorable for the counter-electrode. The negative mold 10 can be advantageously contacted via a thread.

An elevation 38 also forms here in the area of the projection 22 and the first elevation 34. The second layer 36 can be advantageously made of nickel, for example. The projection 22 of the elements 20 (illustrated by 20*a* in the section shown) is now deeply embedded into the two layers 32, 36. The two layers 32, 36 result in a total layer thickness d30v.

A favorable layer thickness d32 of the first layer 32 is between around 5 and 15 μm, preferably between 8 and 12 μm. A favorable thickness d36 of the second layer 36 is between around 30 and 50 μm, preferably between 35 and 45 μm, with an axial thickness of the elements 20 (illustrated by 20*a* in the section shown) of between for example 40 and 80 μm preferably between 50 and 70 μm.

Figure 6:
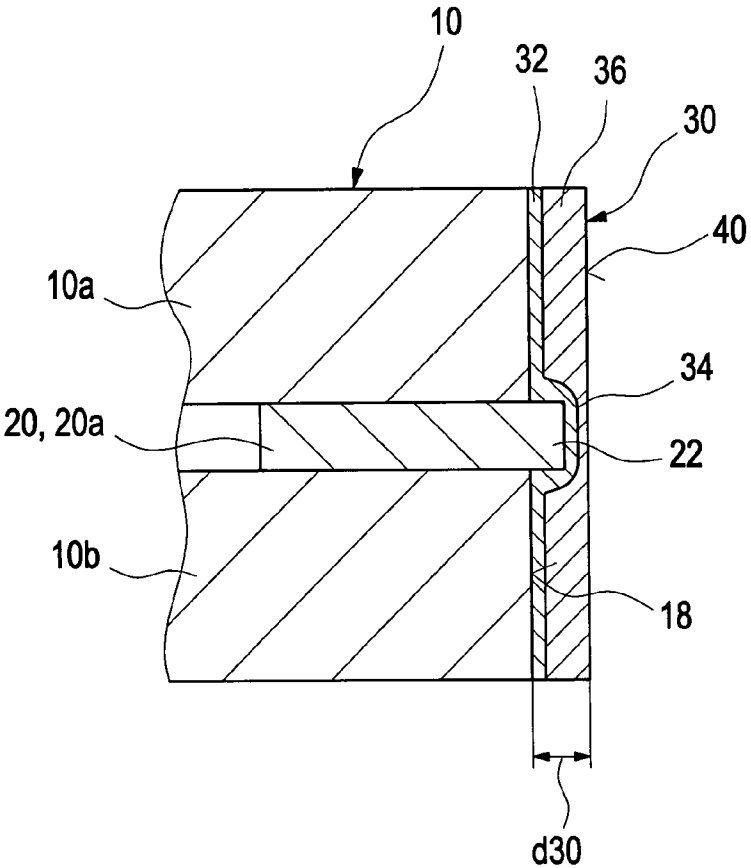
FIG. 6 the negative mold from FIG. 5 with leveled surface of the layer.

As illustrated in FIG. 6, the negative mold 10 undergoes in a further method step a surface treatment in which the elevation 38 is ablated, and the negative mold 10 is for example finish-turned and/or polished, obtaining the thickness d30. The elevation 38 can be practically completely removed, so that for example a surface 40 appearing to be reflecting at least to the naked eye is obtained, even in the area of the elements 20 (illustrated by 20*a* in the section shown).

Depending on requirements, it is also possible to apply one or more further layers instead of the two layers 32, 36, in order to obtain a function layer with a required layer thickness d30.

It is thus possible, if required, for a layer (not shown) to be applied as a protective layer or decorative layer with a low thickness of, for example, 1-10 μm, such as a gold layer, a chromium layer, a silver layer, a decorative colored layer of a metal like titanium nitride or an anodically generated oxide, or the like.

Figure 7:
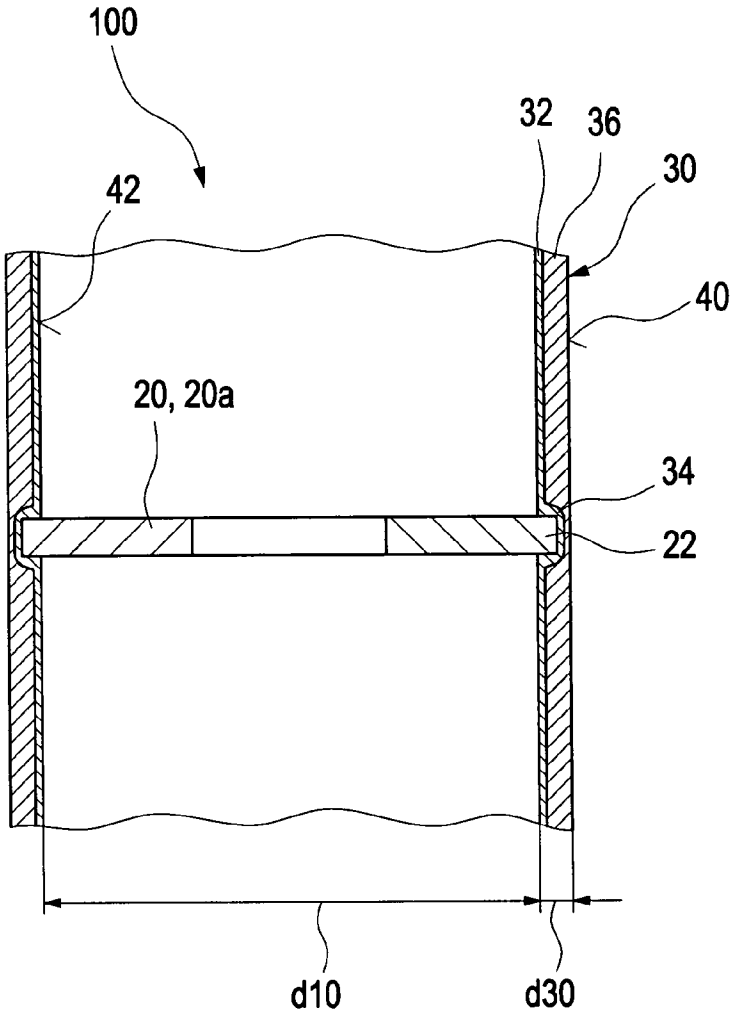
FIG. 7 a self-supporting surface in which the negative mold was selectively removed.

FIG. 7 shows a section through a composite body 100 with a self-supporting surface 30 in the form of a sleeve with a thickness d30, into which elements 20 (illustrated by 20*a* in the section shown) are embedded, as the end product of the steps described above in which the negative mold 10 was selectively removed. If necessary, the elements 20 can be colored in a further treatment step. The composite body 100 has an outer surface 40 and an inner surface 42.

To remove the negative mold 10, it can be selectively chemically dissolved. If the individual parts 10*a*, 10*b*, 10*c*, 10*d* of the negative mold 10 comprise for example aluminum, they can be easily dissolved with caustic soda. The elements 20 (illustrated by 20*a* in the section shown) of copper remain, as they are not attacked by the caustic soda. A self-supporting sleeve with a wall thickness d30 of for example about 50 μm can be produced that has a smooth surface 40 and in the interior a complex structure for example of elements 20 (illustrated by 20*a* in the section shown) permanently connected to the self-supporting surface 30 and having a comparable thickness. Particularly in those areas at which elements 20 are permanently embedded on the inside of the thin envelope, a surface condition of the surface 40 can be achieved that appears homogeneous at least to the naked eye and for example reflects when the surface 40 is polished or appears homogeneously matt with a selectively roughened surface 40.

The invention claimed is:

1. Method for producing a composite body from at least one self-supporting first surface and at least one element connected to the at least one self-supporting first surface in a coating process, wherein a negative mold is provided having a diameter with an oversize relative to a diameter of a final dimension of the negative mold, and comprising the at least one element of the composite body, the method comprising:

(a) smoothing the negative mold on an outer second surface as a whole prior to a selective ablation in order to set the at least one element in the negative mold to a required dimension, wherein the outer second surface is adapted to be coated;

(b) selectively ablating the outer second surface of the negative mold to be coated with the at least one self-supporting first surface by a defined first thickness such that the at least one element stands out from the outer second surface as a defined projection at least in some areas, wherein the first thickness is between 5 μm and 25 μm;

(c) depositing one or more layers for forming the at least one self-supporting first surface having a defined second thickness, wherein an elevation forms in the area of the projection of the at least one element and the projection of the at least one element is embedded in the at least one self-supporting first surface, wherein the at least one self-supporting first surface is formed from a first layer and a second layer, the first layer having a smaller thickness than the second layer, a thickness of the first layer being between around 5-15 μm and a thickness of the second layer being between around 30-50 μm, and wherein a thickness of the at least one self-supporting first surface is less than a sum of the thickness of the first layer and the second layer;

(d) leveling of a coated, outer, third surface of the at least one self-supporting first surface, wherein the elevation is removed and the coated, outer, third surface is formed having a homogeneous appearance, (e) selectively removing at least parts of the negative mold.

2. Method according to claim 1, comprising achieving the deposition of the one or more layers onto the negative mold by electroforming.

3. Method according to claim 1, comprising finish-turning the negative mold as a whole before the selective ablation in order to set the at least one element in the negative mold to the required dimension.

4. Method according to claim 1, comprising achieving selective ablation of the negative mold by a wet chemical treatment.

5. Method according to claim 1, wherein the at least one self-supporting first surface has a greater thickness than the projection of the at least one element.

6. Method according to claim 5 the thickness of the at least one self-supporting first surface is at least five times greater than the projection of the at least one element.

7. Method according to claim 1, comprising ablating the elevation so that the coated negative mold is as a whole finish-turned and/or ground.

8. Method according to claim 1, performing a surface treatment, preceding a galvanic deposition, increase the adhesive strength between the at least one element and the at least one self-supporting first surface.

9. Method according to claim 1, comprising polishing the at least one self-supporting first surface before removal of the negative mold.

10. Method according to claim 1, comprising removing the negative mold by selective chemical etching.

11. Method according to claim 1, comprising producing the at least one self-supporting first surface from a layer of copper or a copper-containing component and from a layer of nickel or a nickel-containing component deposited thereon.

12. Method according to claim 1, the at least one element, is produced from copper or a copper-containing component.

13. Method according to claim 1, comprising producing the negative mold at least in some areas from aluminum.

14. Method according to claim 13, comprising producing the negative mold in that an aluminum part and an element to be connected to the at least one self-supporting first surface are joined together alternatingly in a stacking direction to form a stack and the stack is subjected to a compressive stress in the stacking direction.

15. Method according to claim 1, the coated, outer, third surface is polished to be reflecting.

* * * * *